US011482394B2

(12) United States Patent
Sommerer et al.

(10) Patent No.: US 11,482,394 B2
(45) Date of Patent: Oct. 25, 2022

(54) BIDIRECTIONAL GAS DISCHARGE TUBE

(71) Applicant: General Electric Company, Schenectady, NY (US)

(72) Inventors: Timothy John Sommerer, Ballston Spa, NY (US); Joseph Darryl Michael, Delmar, NY (US); David John Smith, Clifton Park, NY (US)

(73) Assignee: General Electric Technology Gmbh, Baden (CH)

( * ) Notice: Subject to any disclaimer, the term of this patent is extended or adjusted under 35 U.S.C. 154(b) by 0 days.

(21) Appl. No.: 16/740,096

(22) Filed: Jan. 10, 2020

(65) Prior Publication Data

US 2021/0217573 A1 Jul. 15, 2021

(51) Int. Cl.

| | |
|---|---|
| ***H01J 17/44*** | (2006.01) |
| ***H01J 13/52*** | (2006.01) |
| ***H01J 13/08*** | (2006.01) |
| ***H01J 17/06*** | (2006.01) |

(52) U.S. Cl.

CPC ..... *H01J 17/44* (2013.01); *H01J 13/08* (2013.01); *H01J 13/52* (2013.01); *H01J 17/066* (2013.01)

(58) Field of Classification Search

None

See application file for complete search history.

(56) References Cited

U.S. PATENT DOCUMENTS

| | | | | |
|---|---|---|---|---|
| 2,242,351 A | | 5/1941 | Etzrodt | |
| 2,617,969 A | * | 11/1952 | Malter | H03K 3/55 313/15 |
| 2,730,655 A | * | 1/1956 | Geisler | H03K 23/82 315/165 |
| 2,786,966 A | * | 3/1957 | Taylor | H02M 1/042 315/194 |

(Continued)

FOREIGN PATENT DOCUMENTS

| | | |
|---|---|---|
| AU | 3381071 A | 3/1973 |
| CN | 1601843 A | 3/2005 |

(Continued)

OTHER PUBLICATIONS

Cold cathode pulsed power plasma discharge switch by Dan M Goebel Rev Sci Inst 67 Sep. 9, 1996 ,p. 3136 to 3148.*

(Continued)

*Primary Examiner* — Srinivas Sathiraju

(74) *Attorney, Agent, or Firm* — Eversheds Sutherland (US) LLP

(57) ABSTRACT

A bidirectional gas discharge tube (GDT) includes a discharge chamber, first and second cathodes, a gas disposed within the discharge chamber, and a control grid. The first and second cathodes are disposed within the discharge chamber and include first and second faces, respectively. The first face and the second face are plane-parallel. The gas is configured to insulate the first cathode from the second cathode. The control grid is disposed between the first and second cathodes within the discharge chamber. The control (Continued)

Figure 1:
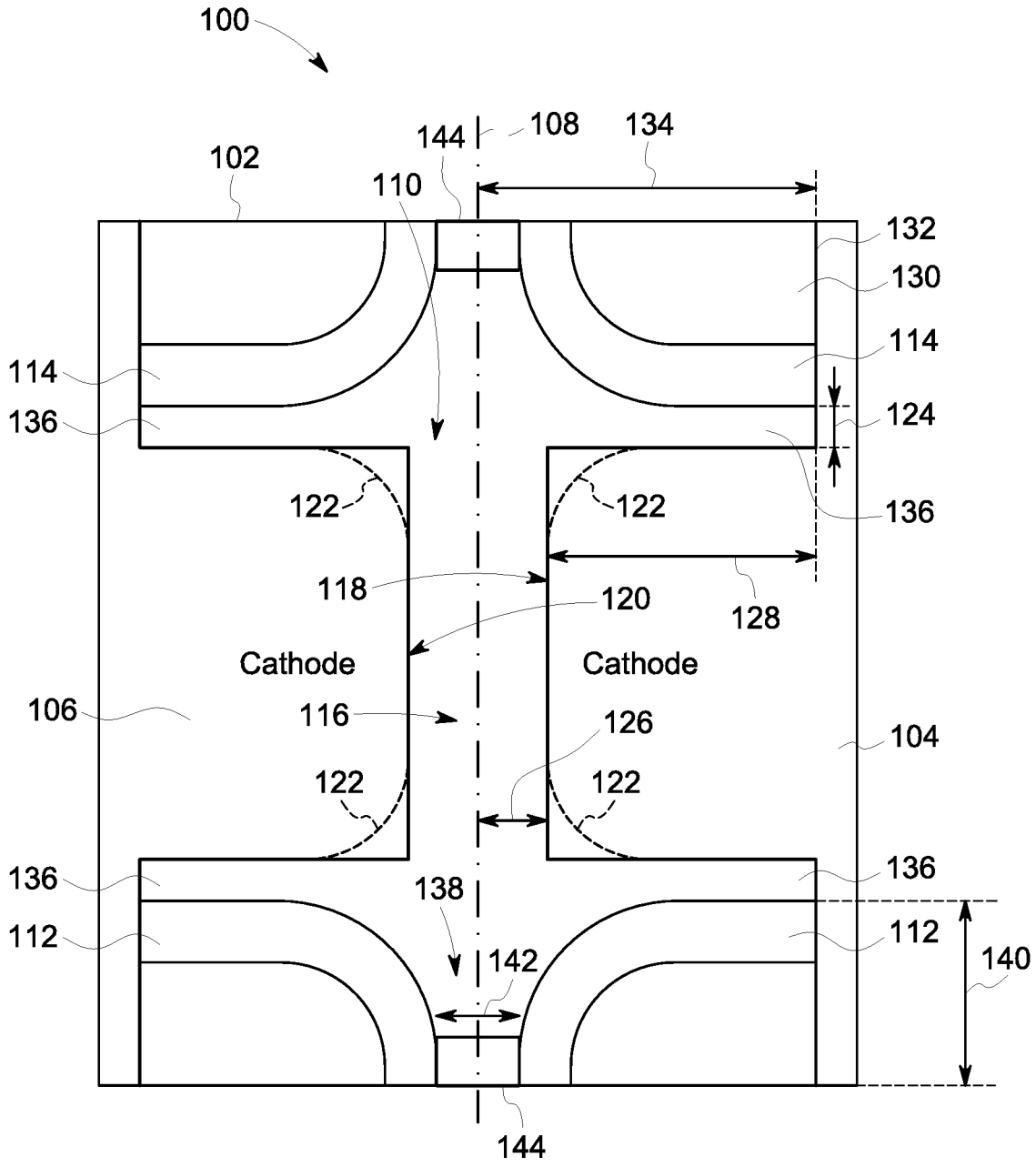

grid is configured to generate an electric field to initiate establishment of a conductive plasma between the first and second cathodes to close a conduction path extending between the first and second cathodes.

16 Claims, 2 Drawing Sheets

(56) References Cited

U.S. PATENT DOCUMENTS 2,786,967 A * 3/1957 Kuenning ..... H02M 1/042 323/318
3,008,097 A * 11/1961 Tetenbaum ..... H01J 17/04 333/13
3,056,088 A * 9/1962 Stearns ..... H03K 3/55 327/100
3,225,335 A * 12/1965 Glenn ..... G11B 13/00 430/21
4,396,865 A * 8/1983 Britt ..... H01J 17/00 315/363
4,409,492 A * 10/1983 Abramian ..... H03K 3/53 323/361
4,594,630 A 6/1986 Rabinowitz, et al.
4,596,945 A * 6/1986 Schumacher ..... H01J 17/44 315/111.41
4,890,040 A * 12/1989 Gundersen ..... H03K 3/55 315/156
4,891,686 A * 1/1990 Krausse, III ..... H01L 23/4006 257/664
4,939,416 A * 7/1990 Seeboeck ..... H01J 17/44 313/631
5,055,748 A * 10/1991 Reinhardt ..... H01J 17/44 315/330
5,075,592 A * 12/1991 Seeboeck ..... H01J 17/44 313/590
5,329,205 A 7/1994 Goebel et al.
5,386,172 A * 1/1995 Komatsu ..... H01J 9/025 313/309
5,451,836 A * 9/1995 Barry ..... H01J 17/30 313/590
5,828,176 A 10/1998 Goebel
5,841,235 A * 11/1998 Engelko ..... H01J 3/025 315/111.21
5,907,595 A * 5/1999 Sommerer ..... H01J 35/066 378/119
6,049,174 A * 4/2000 Pirrie ..... H01J 17/30 313/595
6,104,022 A * 8/2000 Young ..... H01J 17/40 313/538
6,417,604 B1 * 7/2002 Hartmann ..... H01J 17/44 315/111.41
7,643,265 B2 * 1/2010 Loader ..... H01T 1/14 361/120
7,847,484 B2 * 12/2010 Smith ..... H01J 61/18 313/637
8,169,145 B2 * 5/2012 Boy ..... H01T 4/12 313/631
9,025,353 B2 * 5/2015 Birnbach ..... G05F 1/10 363/178
9,552,942 B2 1/2017 Yamashita et al.
9,711,287 B2 * 7/2017 Bimbach ..... G05F 1/10
9,791,876 B2 10/2017 Davidson
10,186,842 B2 * 1/2019 Rozman ..... H01T 4/12
10,685,805 B2 * 6/2020 Rozman ..... H01T 4/16
2003/0026055 A1 * 2/2003 Bobert ..... H01T 4/12 361/117
2006/0132043 A1 * 6/2006 Srivastava ..... C09K 11/617 313/638
2007/0159114 A1 * 7/2007 Chang ..... H05B 41/2822 315/274
2011/0234101 A1 * 9/2011 Teske ..... H01T 2/00 315/111.21
2012/0081097 A1 * 4/2012 Birnbach ..... H02H 9/08 313/7
2012/0307970 A1 * 12/2012 Sommerer ..... A61B 6/4007 378/62
2013/0063119 A1 * 3/2013 Lubomirsky ..... H02M 3/1563 323/304
2014/0227548 A1 * 8/2014 Myrick ..... C06B 45/30 203/40
2015/0187501 A1 * 7/2015 Birnbach ..... H01J 5/02 361/302
2015/0187531 A1 * 7/2015 Birnbach ..... G05F 1/10 313/7
2016/0020057 A1 1/2016 Sommerer et al.
2017/0352508 A1 12/2017 Chung et al.
2018/0096816 A1 * 4/2018 Lemaitre ..... A61B 6/40
2018/0350481 A1 * 12/2018 Choi ..... H02N 11/002

FOREIGN PATENT DOCUMENTS

CN 201438603 U 4/2010
EP 3364533 A1 8/2018
EP 3465848 A1 4/2019
WO 2014142974 A1 9/2014
WO 2020190290 A1 9/2020

OTHER PUBLICATIONS

Xenon Plasma as a potential source for EUV and soft X-radiations by Akel et al Vacuum 101 (2014) 360-366.*
Observation of increased space change limited thermionic electron emission current by neutral gas ionization in a weakly ionized deuterium plasma By Hollmann et al (Hollmannl J appl. Phys 1118 103302 (2015).*
Design and thermal analysis of the insert region heater of a lanthanum hexaboride hollow cathode by Ozturk et al. (Ozturk) p. 607-612, (2013) International conference on Space Technologies (RAST) IEEE publications.*
Krefft et al., "Design Problems Of High Voltage Multi-Grid Hydrogen Thyratron Tubes", 1966 International Electron Devices Meeting, pp. 74-74, Washington, DC, USA, Oct. 26, 1966.
Goebel, "Cold-Cathode, Pulsed-Power Plasma Discharge Switch", Review of Scientific Instruments, vol. 67, Issue: 09, pp. 1-13, Jun. 4, 1998.
International Search Report & Written Opinion dated Apr. 22, 2021.
Pirrie C A et al: "The evolution of the hydrogen thyratron", Conference Record of The 2000 Twenty-Fourth International Power Modulator Symposium, Norfolk, VA; [International Power Modulator Symposium], IEEE, Piscataway, NJ, Jun. 26, 2000 (Jun. 26, 2000), pp. 9-16, XP032142304, DOI: 10.1109/MODSYM.2000.896153, ISBN: 978-0-7803-5826-3 Y, figure 12, p. 14.

* cited by examiner

BIDIRECTIONAL GAS DISCHARGE TUBE

BACKGROUND

The field of the disclosure relates generally to high-voltage switching and, more particularly, to bidirectional gas discharge tubes.

Typical electrical systems include a direct current (DC) or alternating current (AC) power source, such as a battery, fuel cell, power supply, photovoltaic system, generator, or electric grid and an electrical load, unit of equipment, or system. These electrical systems may also include one or more switches, or disconnects, arranged between the power source and the electrical load for the purpose of, for example, power conversion, fault current interruption, or overcurrent protection, e.g., circuit breakers. At least some of these switches may be implemented using gas discharge tubes.

DC and AC electrical grids and distribution networks, particularly high-voltage DC grids, require bidirectional current control to enable isolation of the various member components of the DC grid. Conventional gas discharge tubes, while able to withstand a high voltage standoff of either polarity, can conduct current in only one direction, e.g., anode to cathode, absent some other destructive breakdown of the gas discharge tube itself. Consequently, two conventional gas discharge tubes in an antiparallel arrangement would be required to provide bidirectional current control.

BRIEF DESCRIPTION

In one aspect, a bidirectional gas discharge tube is provided. The bidirectional gas discharge tube includes a discharge chamber, first and second cathodes, a gas disposed within the discharge chamber, and a control grid. The first and second cathodes are disposed within the discharge chamber and include first and second faces, respectively. The first face and the second face are plane-parallel. The gas is configured to insulate the first cathode from the second cathode. The control grid is disposed between the first and second cathodes within the discharge chamber. The control grid is configured to generate an electric field to initiate establishment of a conductive plasma between the first and second cathodes to close a conduction path extending between the first and second cathodes.

In yet another aspect, a bidirectional gas discharge tube is provided. The bidirectional gas discharge tube includes a discharge chamber, first and second cathodes, a gas disposed within the discharge chamber, and first and second control grids. The first and second cathodes are disposed within the discharge chamber. The gas is configured to insulate the first cathode from the second cathode. The first control grid is disposed adjacent the first cathode and between the first cathode and the second cathode within the discharge chamber. The first control grid is configured to generate a first electric field to initiate establishment of a conductive plasma between the first cathode and the second cathode to close a conduction path extending between the first cathode and the second cathode. The second control grid is disposed adjacent the second cathode and between the first cathode and the second cathode within the discharge chamber. The second control grid is configured to generate a second electric field to initiate establishment of the conductive plasma and to close the conduction path.

DRAWINGS

Figure 2:
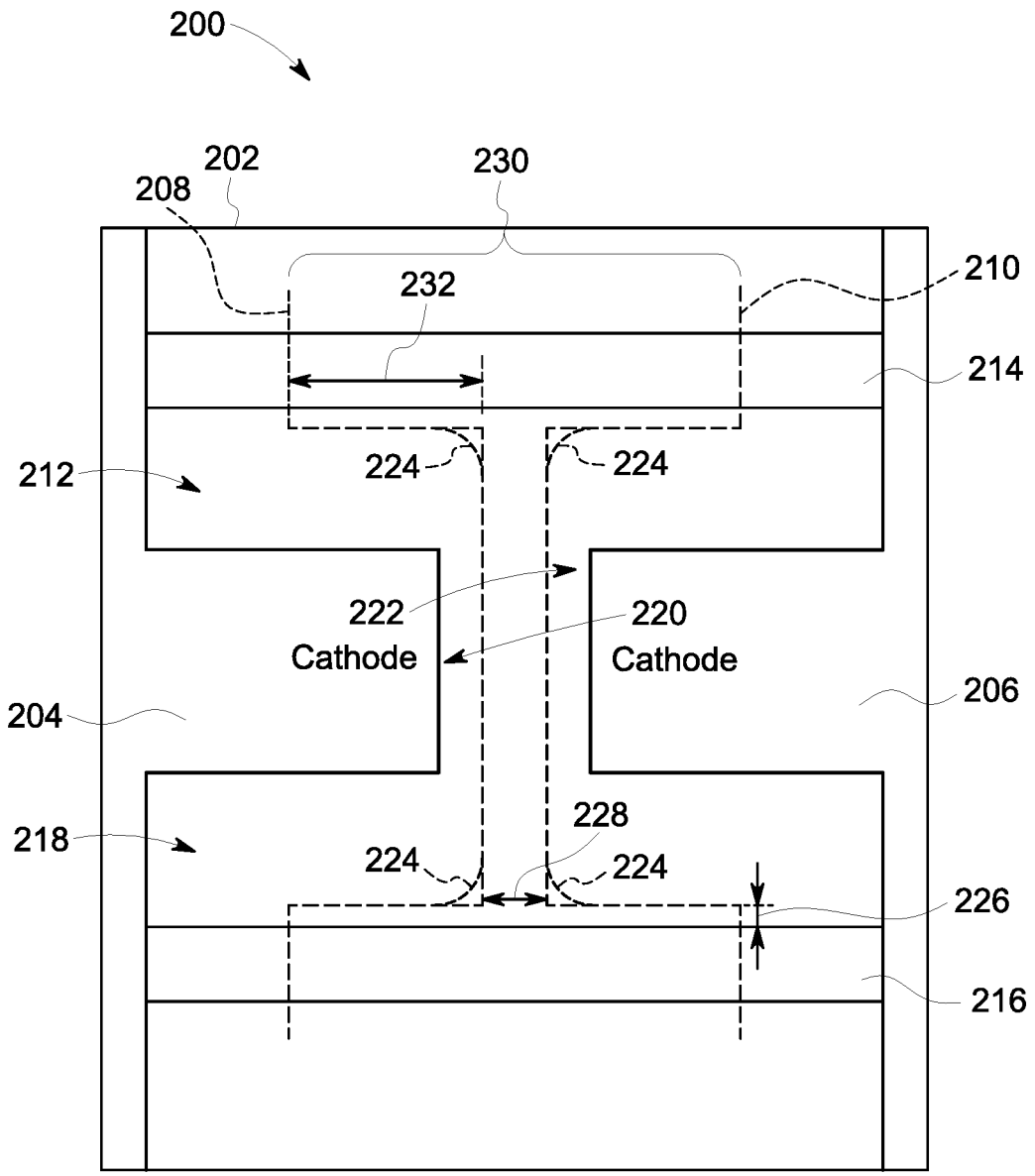

These and other features, aspects, and advantages of the present disclosure will become better understood when the following detailed description is read with reference to the accompanying drawings in which like characters represent like parts throughout the drawings, wherein:

FIG. 1 is a cross-sectional diagram of one embodiment of a bidirectional gas discharge tube; and FIG. 2 is a cross-sectional diagram of another embodiment of a bidirectional gas discharge tube.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, a number of terms are referenced that have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it relates. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

Some embodiments involve the use of one or more electronic processing or computing devices. As used herein, the terms "processor" and "computer" and related terms, e.g., "processing device," "computing device," and "controller" are not limited to just those integrated circuits referred to in the art as a computer, but broadly refers to a processor, a processing device, a controller, a general purpose central processing unit (CPU), a graphics processing unit (GPU), a microcontroller, a microcomputer, a programmable logic controller (PLC), a reduced instruction set computer (RISC) processor, a field programmable gate array (FPGA), a digital signal processing (DSP) device, an application specific integrated circuit (ASIC), and other programmable circuits or processing devices capable of executing the functions described herein, and these terms are used interchangeably herein. The above embodiments are examples only, and thus are not intended to limit in any way the definition or meaning of the terms processor, processing device, and related terms.

In the embodiments described herein, memory may include, but is not limited to, a non-transitory computer-readable medium, such as flash memory, a random access memory (RAM), read-only memory (ROM), erasable programmable read-only memory (EPROM), electrically erasable programmable read-only memory (EEPROM), and non-volatile RAM (NVRAM). As used herein, the term "non-transitory computer-readable media" is intended to be representative of any tangible, computer-readable media, including, without limitation, non-transitory computer storage devices, including, without limitation, volatile and non-volatile media, and removable and non-removable media such as a firmware, physical and virtual storage, CD-ROMs, DVDs, and any other digital source such as a network or the Internet, as well as yet to be developed digital means, with the sole exception being a transitory, propagating signal. Alternatively, a floppy disk, a compact disc-read only memory (CD-ROM), a magneto-optical disk (MOD), a digital versatile disc (DVD), or any other computer-based device implemented in any method or technology for short-term and long-term storage of information, such as, computer-readable instructions, data structures, program modules and sub-modules, or other data may also be used. Therefore, the methods described herein may be encoded as executable instructions, e.g., "software" and "firmware," embodied in a non-transitory computer-readable medium. Further, as used herein, the terms "software" and "firmware" are interchangeable, and include any computer program stored in memory for execution by personal computers, workstations, clients and servers. Such instructions, when executed by a processor, cause the processor to perform at least a portion of the methods described herein. Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

Embodiments of the present disclosure relate to bidirectional gas discharge tubes. The bidirectional gas discharge tubes described herein provide a single gas-tight electrically insulating envelope that provides voltage standoff, current conduction, and current interruption in both directions, i.e., regardless of current polarity. Accordingly, embodiments of the bidirectional gas discharge tubes described herein provide bidirectional current control for DC electrical grids without the addition of an antiparallel-arranged second gas discharge tube, resulting in reduced cost, reduced size, and reduced complexity of the power switch. For example, the inclusion of a second gas discharge tube in antiparallel with a first gas discharge tube results in the use of twice as much space, doubles the cost of gas discharge tubes, and requires double the supporting equipment, such as oil insulation and power electronics for operating the control grids. A single bidirectional gas discharge tube also improves reliability by reducing the number of parts and joints that could fail. The bidirectional gas discharge tubes described herein include two cathodes and one or more control grids. During operation, for a given direction of current flow, one cathode functions as a cathode, while the other cathode, and potentially the control grid, functions as an anode, or "anodic cathode." Further, each cathode operates with low forward voltage and extended life.

In some embodiments of the bidirectional gas discharge tubes described herein, a single control grid is positioned between the two cathodes to create two high-voltage standoff regions. In at least some embodiments, the cathodes are plane-parallel to each other and to the control grid to maintain proper orientation of the electric fields with respect to the electrode faces, resulting in improved high-voltage standoff performance and reduced gas breakdown. In at least some embodiments, the cathodes include rounded edges to control electric field amplitude around the electrode edges. In such embodiments of the bidirectional gas discharge tubes, the high-voltage standoff for the device is a function of at least the distance between the control grid and each of the electrodes for the two cathodes, as well as the gas type and pressure. For example, this separation should be small enough to prevent electrical breakdown of the intervening gas, and also large enough to prevent undesirable electron emission from the cathodic electrode. Additionally, the separation of the conductors when they exit the external surface of the bidirectional gas discharge tube should be large enough to prevent undesirable electric breakdown, or "flashover," in the medium, or fluid, in which the device is surrounded.

In certain other embodiments of the bidirectional gas discharge tubes described herein, two control grids are positioned between the two cathodes to create one high-voltage standoff region between the two control grids. In at least some embodiments, the control grids include rounded edges to control electric field amplitude around the electrode edges. In such embodiments of the bidirectional gas discharge tubes, the high-voltage standoff for the device is a function of at least the distance between the two control grids, as well as the gas type and pressure. Additionally, the separation of the conductors when they exit the external surface should be at least enough to prevent electrical breakdown on the external surface of the bidirectional gas discharge tube in the medium, or fluid, in which the device is surrounded.

FIG. 1 is a cross-sectional diagram of an exemplary bidirectional gas discharge tube 100. Bidirectional gas discharge tube 100 includes a housing 102, a first cathode 104, a second cathode 106, and a control grid 108. First cathode 104, second cathode 106, and control grid 108 are disposed within a discharge chamber 110 defined at least partially by first cathode 104, second cathode 106, and insulating barriers 112 and 114. In certain embodiments, insulating barriers 112 and 114 are different regions of a single unitary cylindrical insulator. Although this exemplary embodiment includes a single control grid 108, other embodiments may include more than one control grid 108. Generally, current is conducted either from first cathode 104 to second cathode 106, or from second cathode 106 to first cathode 104, over an ionized plasma contained within discharge chamber 110. Discharge chamber 110 is filled with a gas 116 and has a pressure of in the range of about about 0.01-100 pascals depending on at least the type of first cathode 104 and second cathode 106, and the type of gas 116. For example, for cold cathodes, the pressure in discharge chamber 110 may be in the range of about 1-10 pascals. For hot cathodes in hydrogen, or in a hydrogen isotope like deuterium, for example, the pressure may be about 0.1-1.0 pascals. In one embodiment, gas 116 is hydrogen. Alternatively, gas 116 may be any other suitable gas or gases, such as a noble gas or noble gas mixture that enable operation of bidirectional gas discharge tube 100 as described herein. For example, in an alternative embodiment, gas 116 includes the noble gas xenon.

First cathode 104 and second cathode 106, in certain embodiments, are cold cathodes. First cathode 104 and second cathode 106 can conduct high total current over a long operating life with low forward operating losses. In alternative embodiments, first cathode 104 and second cathode 106 may be field emission cathodes, thermionic emission cathodes, or any other suitable type of cathode for establishing a conductive plasma within bidirectional gas discharge tube 100. Thermionic cathodes, for example, have relatively low forward voltages and, consequently, low losses during normal operation, i.e., normal current conduction through bidirectional gas discharge tube 100. For example, first cathode 104 and second cathode 106 may, in certain embodiments, be composed of lanthanum hexaboride (LaB6), or may be a composite structure in which barium (Ba) sets the effective work function, or any other thermionic emitter material with a low work function, such as a rare-earth oxide, metal-carbide, or metal-boride. For example, first cathode 104 and second cathode 106 may include a tungsten sponge embedded with barium oxide, where the barium oxide decomposes into metallic barium during operation and migrates to exterior surfaces where it affects the electron emission properties of the surface.

Generally, a cathode emits electrons by secondary emission, field emission, or by thermionic emission. Secondary emission is a response to incident particles that carry some amount of electron-volts of kinetic or latent energy (e.g., energy above the thermal energy of 0.025 eV at room temperature) such as ions, electronically-excited atoms, or photons. Field emission is a response to a strong electric field at the surface that pulls electrons out of their trapping potential well (generally requiring, for example, more than about 1 GV/m of electric field). Thermionic emission occurs when the cathode metal is heated until electrons "boil off" over their trapping potential well. The potential well is defined by a work-function of the material, which varies from 1-5 eV for most materials. Generally, electron emission can occur by all three mechanisms at the same time and, in some cases, the mechanisms cooperate. For example, thermionic emission and field emission can cooperate to produce field-enhanced thermionic emission. However, one emission mechanism typically dominates the others, and the cathode is referred to by the dominant emission mechanism.

Control grid 108 is an electrode used to selectively control gas discharge tube 100 through application, removal, and/or variation of an electric field. In certain embodiments, control grid 108 is a thin shell (e.g., about 0.5 mm thick) with apertures that allow plasma current to pass through. The apertures may be circular holes arranged in an array, each with some diameter that enables control grid 108 to stop a given current density of plasma current flow when desired. For example, the diameter, in certain embodiments, may range from about 0.5 mm to about 2 mm. In one example embodiment, the diameter is about 1 mm. Likewise, the spacing between the apertures may be as close as possible to maximize area for plasma current passage without sacrificing the mechanical integrity of control grid 108. For example, in certain embodiments, the spacing from edge-to-edge is about 15 micrometers. In alternative embodiments, the aperture diameter and spacing may be more or less for a given application of control grid 108 and gas discharge tube 100.

In the embodiment of FIG. 1, electrons are emitted from either first cathode 104 or second cathode 106 depending on the polarity of current conducted through bidirectional gas discharge tube 100. The electrons pass through gas 116 within discharge chamber 110, and are collected at the opposite cathode, i.e., either second cathode 106 or first cathode 104 depending on the polarity of current. Control grid 108 is one or more electrodes used to selectively control bidirectional gas discharge tube 100 through application, removal, and/or variation of an electric field. For example, to close the circuit, control grid 108 is energized to create an electric field that draws conducting plasma from the region between either first cathode 104 and control grid 108, or the region between second cathode 106 and control grid 108, and enables formation of an ionized gas 116 within discharge chamber 110. When bidirectional gas discharge tube 100 is closed (e.g., turned on, conducting, etc.), gas 116 within discharge chamber 110 becomes ionized (i.e., some portion of the molecules are dissociated into free electrons and ions), resulting in an electrically conductive plasma that connects first cathode 104 and second cathode 106. Where gas 116 is a molecular gas, such as hydrogen, then the plasma may also contain molecular ions and neutral fragments of the molecules.

Where first cathode 104 and second cathode 106 are cold cathodes, electrical continuity is maintained between first cathode 104, or second cathode 106, and gas 116 through secondary electron emission by ion impact. Energetic (e.g., 50-500 electron volts (eV)) ions from the plasma are drawn to the surface of first cathode 104 or second cathode 106 by a strong electric field. The impact of the ions on first cathode 104 or second cathode 106 releases secondary electrons from the surface of first cathode 104 or second cathode 106 into the gas phase. The released secondary electrons aid in sustaining the plasma. Magnets are typically used to create a magnetic field of about 100-1000 Gauss near the cathode surface to increase current density at the cathode surface to useful levels, e.g., greater than 1.0 A/cm$^2$. Accordingly, in such embodiments, control grid 108 does not need to be continuously energized to maintain the plasma for normal forward conduction operation. In alternative embodiments, where first cathode 104 and second cathode 106 are thermionic cathodes, first cathode 104 and second cathode 106 release electrons in response to heat that, for example, is externally applied by a heating element. In certain embodiments, first cathode 104 and second cathode 106 are heated as a result of recombination of incident ions at the surface of first cathode 104 or second cathode 106, as well as by the kinetic energy they carry.

Generally, in embodiments of bidirectional gas discharge tubes described herein, such as bidirectional gas discharge tube 100 shown in FIG. 1, the material of first cathode 104 and second cathode 106 does not evaporate to an extent that it substantially changes the properties of gas 116, either in its insulating state, or in its conducting state. Conversely, for example, mercury cathodes can emit mercury vapor during operation, potentially degrading the cathode and shortening the service life of the cathode, and necessitating careful control of mercury vapor pressure and cathode temperatures. Alternatively, there is some interaction between gas 116 and evaporated material from first cathode 104 or second cathode 106. When bidirectional gas discharge tube 100 is opened (e.g., turned off, not conducting, etc.), gas 116 insulates first cathode 104 from second cathode 106.

First cathode 104 and second cathode 106 include plane-parallel faces 118 and 120, respectively. Notably, plane-parallel faces 118 and 120 are also plane-parallel with control grid 108. Generally, vacuum breakdown and gas breakdown in gas discharge tubes occurs where the field is strongest, or where the gas insulation is weakest. Plane-parallel faces 118 and 120 produce electric field lines that are approximately perpendicular to plane-parallel faces 118 and 120. Plane-parallel faces 118 and 120 result in good high-voltage standoff performance and resistance to electric breakdown of gas 116. Plane-parallel faces 118 and 120 enable an electric field on the surface of first cathode 104 or second cathode 106, or on control grid 108 at a negative potential, that is as uniform as possible, and a field strength as close to the material field emission limit of first cathode 104 and second cathode 106, and gas 116. For example, good high-voltage materials, such as stainless steel or molybdenum, can sustain electric field strengths on the order of 100 kV/cm. Uniform electric fields near the material limit ensure there are no localized areas of higher electric field where field emission could start. Similarly, gas breakdown, or runaway ionization in bulk gas, may occur at any localized volume where the voltage between the electrodes exceeds Paschen's breakdown criterion, e.g., as a result of pressure and electrode spacing. Plane-parallel faces 118 and 120 enable both uniform field strength and uniform electrode spacing, e.g., between first cathode 104 or second cathode 106 and control grid 108.

In certain embodiments, first cathode 104 and second cathode 106 include rounded edges 122 to reduce the degree to which the electric field becomes larger at the edges of first cathode 104 and second cathode 106, and to prevent degradation of high-voltage standoff performance, e.g., resistance to electric breakdown of the gas or field emission leading to vacuum breakdown.

In certain embodiments, first cathode 104, control grid 108, and second cathode 106 are implemented as concentric cylinders. In such embodiments, conduction occurs between concentric walls, or "nested" walls, of the cylinders that form first cathode 104 and second cathode 106, as opposed to between plane-parallel faces 118 and 120 of first cathode 104 and second cathode 106, respectively. As in the planar geometry shown in FIG. 1, insulating barrier 114 and insulating barrier 112 may be implemented as a single insulating cylinder disposed within housing 102. Likewise, insulating barrier 112 and insulating barrier 114 themselves be integrated with housing 102. Moreover, in such an embodiment, the insulating cylinder, first cathode 104, and second cathode 106 are all dimensioned to define a space in the form of an annulus between the insulating cylinder and each of first cathode 104 and second cathode 106, and to define spacing between each successive cylinder that form first cathode 104, control grid 108, and second cathode 106. For example, the radius of curvature must be sufficiently large to prevent excessive field concentration on the inner cylinder, leading to undesirable vacuum breakdown, and the annulus should be sufficiently small to prevent Paschen, or gas, breakdown.

In at least some embodiments, first cathode 104 and second cathode 106 are positioned such that a space 124 between first cathode 104 or second cathode 106 and insulating barrier 112 or insulating barrier 114 is small, to inhibit triple-point emission. A triple-point exists where metal, insulator, and a volume of gas or under vacuum meet. When such a location is at a negative potential (e.g., cathodic) relative to some facing structure, then strong electric fields can form nearby that lead to undesirable electron emission that initiates an electrical breakdown. In gas discharge tubes, triple-points exist where metal electrodes meet the insulator, e.g., where first cathode 104 or second cathode 106 meet insulating barrier 112 or insulating barrier 114. Triple-point emission is mitigated in gas discharge tube 100 by locating the triple-points in deep narrow recesses 136 between each of insulating barriers 112 and 114 and each of first cathode 104 and second cathode 106. Recesses 136 inhibit triple-point emission as well as flashover and gas breakdown if some small amount of triple-point emission still occurs.

For example, in certain embodiments, space 124 is approximately 1 millimeter, or in the range of about 0.5 to 1 millimeter. Space 124 may, in certain embodiments, be larger or smaller based on the specific application, e.g., standoff voltage requirements. In embodiments where bidirectional gas discharge tube 100 is cylindrical, as opposed to planar geometry shown in FIG. 1, spacing 124 is a distance between insulating barriers 112 and 114 and first cathode 104, and between insulating barriers 112 and 114 and second cathode 106. Bidirectional gas discharge tube 100 has spacing 124 that is smaller than a spacing 128 between, for example, a feedthrough 132 for first cathode 104 and face 118 of first cathode 104. Spacing 128 is a depth of annular recess 136. In certain embodiments, spacing 128 is at least three times spacing 124. Further, in certain embodiments, spacing 128 is at least ten times spacing 124.

Voltage standoff performance of bidirectional gas discharge tube 100 also depends on the standoff capability external to discharge chamber 110. For example, voltage standoff is also a function of a space 134 between feedthrough 132 for first cathode 104 and control grid 108. Space 134 should be sufficiently large to prevent electrical breakdown or flashover on the exterior surface of the volume of housing 102, which may be disposed in a medium such as, for example, air or an electrically insulating oil. For example, in certain embodiments, space 134 is in the range of about 2 cm to 20 cm. Moreover, to mitigate triple-point emission from the triple-point created where control grid 108 meets insulating barriers 112 and 114, the triple-points are located in recesses 138 having a depth 140 and a radius 142. Recesses 138 extend radially with radius 142, in certain embodiments, of about 0.5 to 1 millimeter and a depth 140 that is at least three times radius 142. In certain embodiments, depth 140 is at least ten times radius 142.

In certain embodiments, bidirectional gas discharge tube 100 further includes seals 144 disposed around each feedthrough for control grid 108. Seals 144 are disposed in recesses 138 where control grid 108 meets insulating barriers 112 and 114. Seals 144 may be formed, for example, by brazing or composed of a sealing glass. Similar seals may be implemented at any point where an electrode, such as first cathode 104, second cathode 106, or control grid 108, exit through insulating barriers 112 and 114.

Generally, voltage standoff is a function of a space 126 between control grid 108 and each of first cathode 104 and second cathode 106. Paschen's gas breakdown criterion sets an upper-limit on electrode spacing for a given voltage, gas type, and gas pressure. In particular, for bidirectional gas discharge tube 100, standoff voltage performance is largely a function of space 126 between either of plane-parallel faces 118 or 120 of first cathode 104 or second cathode 106 and control grid 108. For example, space 126, in certain embodiments, may be about 1 cm per 100 kV of rated voltage (where the rated voltage is the higher of the nominal system voltage and a transient interruption voltage for the electrical system). For example, for a voltage rating of 50-300 kV, spacing 126 should be about 0.5-3 cm. In alternative embodiments, spacing 126 in such embodiments may be within the range of about 0.25-10 cm. Accordingly, first cathode 104 and second cathode 106 can be spaced sufficiently apart, i.e., spacing 126 is sufficiently large, to enable insertion of control grid 108 between first cathode 104 and second cathode 106.

Standoff voltage performance is also a function of the type of gas 116 and the pressure within discharge chamber 110. In embodiments of bidirectional gas discharge tube 100, a conductive plasma will form, and current will conduct, through discharge chamber 110 with relatively low internal gas pressure and relatively large electrode separation.

FIG. 2 is a cross-sectional diagram of an exemplary bidirectional gas discharge tube 200. Bidirectional gas discharge tube 200 includes a housing 202, a first cathode 204, a second cathode 206, a first control grid 208, and a second control grid 210. First cathode 204, second cathode 206, first control grid 208, and second control grid 210 are disposed within a discharge chamber 212 defined at least partially by insulating barriers 214 and 216. Generally, as in bidirectional gas discharge tube 100 (shown in FIG. 1) current is conducted either from first cathode 204 to second cathode 206, or from second cathode 206 to first cathode 204, over an ionized plasma contained within discharge chamber 212. Discharge chamber 212 is filled with a gas 218 and has a pressure of in the range of about 0.01-100 pascals depending on at least the type of first cathode 204 and second cathode 206, and the type of gas 218. For example, for cold cathodes, the pressure in discharge chamber 212 may be in the range of about 1-10 pascals. For hot cathodes in hydrogen, for example, the pressure may be about 0.1-1 pascal. In one embodiment, gas 218 is hydrogen. Alternatively, gas 218 may be any other suitable gas or gases, such as deuterium, or a noble gas or noble gas mixture that enables operation of bidirectional gas discharge tube 200 as described herein. For example, in an alternative embodiment, gas 218 includes the noble gas xenon.

First cathode 204 and second cathode 206 may be cold cathodes, field emission cathodes, thermionic emission cathodes, or any other suitable type of cathode for establishing a conductive plasma within bidirectional gas discharge tube 200. In certain embodiments, first cathode 204 and second cathode 206 are thermionic cathodes having relatively low forward voltages to reduce losses during normal operation, i.e., normal current conduction through bidirectional gas discharge tube 200. For example, first cathode 204 and second cathode 206 may, in certain embodiments, be composed of lanthanum hexaboride (LaB6), a barium-containing structure, or any other thermionic emitter material with a low work function, such as a rare-earth oxide, metal-carbide, or metal-boride. A LaB6 cathode as described herein exhibits a forward voltage drop of about 20 V where gas 218 is deuterium, or about 5 V where gas 218 is xenon. Conversely, solid metal cold cathodes composed of materials such as stainless steel or molybdenum exhibit forward voltage drops in the range of about 150-500 V. Certain other cold cathodes may exhibit lower forward voltage in the range of about 50-150 V.

First cathode 204 and second cathode 206 conduct high total current over a long operating life with low forward operating losses. In operation, electrons are emitted from either first cathode 204 or second cathode 206 depending on the polarity of current conducted through bidirectional gas discharge tube 200. The electrons pass through gas 218 within discharge chamber 212, and are collected at the opposite cathode, i.e., the cathode functioning as an anode, which is either second cathode 206 or first cathode 204 depending on the polarity of current. First control grid 208 and second control grid 210 each include one or more electrodes used to selectively control bidirectional gas discharge tube 200 through application, removal, and/or variation of one or more electric fields. For example, to close the circuit in one direction, first control grid 208 is energized to create an electric field that draws conducting plasma from the region between first cathode 204 and first control grid 208 to enable ionization of gas 218 within discharge chamber 212. Conversely, to close in the opposite direction, second control grid 210 is energized to create an electric field that draws conducting plasma from the region between second cathode 206 and second control grid 210 to enable ionization of gas 218 within discharge chamber 212. When bidirectional gas discharge tube 200 is closed (e.g., turned on, conducting, etc.), gas 218 within discharge chamber 212 becomes ionized (i.e., some portion of the molecules, e.g., hydrogen molecules, are dissociated into free electrons, hydrogen molecular ions, hydrogen atoms, hydrogen atomic ions, etc.), resulting in an electrically conductive plasma that electrically connects first cathode 204 and second cathode 206. The cathode functioning as an anode collects electrons along its entire surface as well as on any connected structures, such as, for example, fins or shields. In some cases, the control grid nearest the cathodic functioning as an anode can be electrically connected to that cathode to collect electrons during normal conduction. Such electron collection enables efficient heat management and reduces voltage drop in gas 218 near that cathode.

When bidirectional gas discharge tube 200 is conducting current in one direction, e.g., with electron emission from first cathode 204, and gas discharge tube 200 is to be opened, first control grid 208 is pulled to a potential below that of first cathode 204 to repel electrons from the vicinity of first control grid 208. The potential applied to control grid 208, relative to first cathode 204, is typically about 1-5 kV. Control grid 208 then temporarily functions as the negative electrode relative to both first cathode 204 and second cathode 206. Control grid 208 functions as a cold cathode and is unable to supply sufficient electron current to maintain current continuity with either first cathode 204 or second cathode 206, and the intervening plasma density decreases to zero. Similarly, when bidirectional gas discharge tube 200 is conducting current in the opposite direction, with electron emission current from second cathode 206 to first cathode 204, and when gas discharge tube 200 is to be opened, then the potential of second control grid 210 is pulled to a potential below that of second cathode 206. Second control grid 210 then temporarily functions as the negative electrode and the plasma is interrupted in the same manner as described above with respect to control grid 208.

Where first cathode 204 and second cathode 206 are cold cathodes, electrical continuity is maintained between first cathode 204, or second cathode 206, and gas 218 through secondary electron emission by ion impact. Energetic (e.g., 50-500 electron volts (eV)) ions from the plasma are drawn to the surface of first cathode 204 or second cathode 206 by a strong electric field. The impact of the ions on first cathode 204 or second cathode 206 releases secondary electrons from the surface of first cathode 204 or second cathode 206 into the gas phase.

Accordingly, neither first control grid 208 nor second control grid 210 needs to be continuously externally energized to maintain the plasma for normal forward conduction operation in either direction. Rather, first control grid 208 and second control grid 210 can be electrically disconnected from the external energization once the conductive plasma is sustained and allowed to float. When interrupting normal forward conduction in either direction, the control grid nearest the cathodic electrode (i.e., either first electrode 204 or second electrode 206) functions as a conventional control grid and intercepts current for a sufficient duration (e.g., about 1 microsecond) to allow a high-voltage standoff region defined between first control grid 208 and second control grid 210 to deionize. For example, where the electron flow is from first cathode 204 toward second cathode 206, first control grid 208 functions as a control grid, and second control grid 210 defines the opposite pole of the high-voltage region. Accordingly, second cathode 206 is collecting electrons and is part of the normal electron current path through bidirectional gas discharge tube 200.

In the exemplary embodiment, the material of first cathode 204 and second cathode 206 does not evaporate to an extent that it substantially changes the properties of gas 218, either in its insulating state, or in its conducting state. Alternatively, there is some interaction between gas 218 and evaporated material from first cathode 204 or second cathode 206. When bidirectional gas discharge tube 200 is opened (e.g., turned off, not conducting, etc.), gas 218 insulates first cathode 204 from second cathode 206.

First control grid 208 and second control grid 210 form a high-voltage standoff region between first control grid 208 and second control grid 210, as opposed to between a single control grid and each cathode in the embodiment of FIG. 1. First control grid 208 is disposed within discharge chamber 212 adjacent first cathode 204 and between first cathode 204 and second cathode 206. Likewise, second control grid 210 is disposed within discharge chamber 212 adjacent second cathode 206 and between first cathode 204 and second cathode 206. In certain embodiments, first control grid 208 and second control grid 210 include rounded edges 224 to reduce the degree to which the electric field at the surfaces of first control grid 208 and second control grid 210 become stronger at the edges of first control grid 208 and second control grid 210 (e.g., in the high-voltage region), and to prevent degradation of high-voltage standoff performance, e.g., resistance to electric breakdown of the gas or field emission leading to vacuum breakdown.

In at least some embodiments, first control grid 208 and second control grid 210 are positioned such that a space 226 between control grids 208 and 210 and each of insulating barrier 214 or insulating barrier 216 is small relative to a length 232 from the high-voltage region to the feedthroughs for first control grid 208 and second control grid 210. For example, in certain embodiments, space 226 is approximately 0.5 to 1 millimeter. Space 226 may, in certain embodiments, be larger or smaller based on the specific application, e.g., standoff voltage requirements. Generally, length 232 is at least three times space 226. In certain embodiments length 232 is at least ten times spaces 226.

In certain embodiments, bidirectional gas discharge tube 200 is cylindrical, as opposed to a planar geometry shown in FIG. 2. In such an embodiment, as in the embodiment shown in FIG. 2, insulating barrier 214 and insulating barrier 216 may be implemented as a single insulating cylinder disposed within housing 202. Moreover, in such an embodiment, the insulating cylinder, first control grid 208, and second control grid 210 are all dimensioned to define a space between the insulating cylinder and each of first control grid 208 and second control grid 210.

Generally, for bidirectional gas discharge tube 200, standoff voltage performance is largely a function of a space 228 between faces of first control grid 208 and second control grid 210, as well as a function of the control grid materials. For example, a control grid composed of molybdenum can sustain about 15% stronger electric field without vacuum breakdown compared with, for example, stainless steel. Standoff voltage performance is also a function of the type of gas 218 and the pressure within discharge chamber 212.

Voltage standoff performance of bidirectional gas discharge tube 200 also depends on the standoff capability external to discharge chamber 212. In particular, voltage standoff is a function of a space 230 between external electrodes for first control grid 208 and second control grid 210. Space 230 should be sufficiently large to prevent electrical breakdown or flashover on the exterior surface of the volume of housing 202, which may be disposed in a medium such as, for example, air or an electrically insulating oil.

The above described embodiments of the present disclosure relate to bidirectional gas discharge tubes. The bidirectional gas discharge tubes described herein provide a single gas-tight electrically insulating envelope that provides voltage standoff, current conduction, and current interruption in both directions, i.e., regardless of current polarity. Accordingly, embodiments of the bidirectional gas discharge tubes described herein provide bidirectional current control for DC and AC electrical grids without the addition of an antiparallel-arranged second gas discharge tube, resulting in reduced cost, reduced size, and reduced complexity of the power switch. The bidirectional gas discharge tubes described herein include two cathodes and one or more control grids.

An exemplary technical effect of the methods, systems, and apparatus described herein includes at least one of: (a) providing a single gas-tight electrically insulating envelope with voltage standoff, current conduction, and current interruption in either direction, i.e., regardless of current polarity; (b) reducing size of bidirectional gas discharge tube implementations by elimination of a second antiparallel gas discharge tube; (c) reducing cost by elimination of a second antiparallel gas discharge tube; and (d) improving reliability of bidirectional switching over implementations with two unidirectional gas discharge tubes arranged in antiparallel.

Exemplary embodiments of methods, systems, and apparatus for switching circuits are not limited to the specific embodiments described herein, but rather, components of systems and/or steps of the methods may be utilized independently and separately from other components and/or steps described herein. For example, the methods may also be used in combination with other non-conventional gas discharge tubes, and are not limited to practice with only the systems and methods as described herein. Rather, the exemplary embodiment can be implemented and utilized in connection with many other applications, equipment, and systems that may benefit from reduced cost, reduced complexity, commercial availability, improved manufacturability, and reduced product time-to-market.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A bidirectional gas discharge tube (GDT) comprising:

a discharge chamber;

a first cathode disposed within said discharge chamber and comprising a first face;

a second cathode disposed within the discharge chamber and comprising a second face, wherein the first face and the second face are plane-parallel;

a gas disposed within said discharge chamber and configured to insulate said first cathode from the second cathode;

a control grid disposed between the first cathode and the second cathode within the discharge chamber, the control grid configured to generate an electric field to initiate establishment of a conductive plasma between the first cathode and the second cathode to close a conduction path extending between the first cathode and the second cathode;

at least one insulating barrier at least partially defining the discharge chamber, wherein the at least one insulating barrier is spaced apart from each of the first cathode and the second cathode by a distance of approximately 0.5 to 1 millimeter;

wherein the at least one insulating barrier defines a recess through which the control grid extends radially toward an external surface, the recess having a depth dimension of at least three-times a width dimension, wherein the depth dimension is parallel to the control grid; and a seal disposed in the recess defined by the at least one insulating barrier, the seal formed around the control grid.

2. The bidirectional GDT of claim 1, wherein at least one of the first cathode or the second cathode is a cold cathode.

3. The bidirectional GDT of claim 1, wherein the control grid forms a first high-voltage standoff region between the first cathode and the control grid, and forms a second high-voltage standoff region between the second cathode and the control grid.

4. The bidirectional GDT of claim 1, wherein the first cathode and the second cathode have rounded edges.

5. The bidirectional GDT of claim 1, wherein the first face and the second face are spaced apart by a distance in the range of about 0.5 to 20 centimeters.

6. The bidirectional GDT of claim 1 further comprising:

an electrode for the control grid extending externally from the discharge chamber; and respective electrodes for the first cathode and the second cathode extending externally from the discharge chamber, wherein the electrode for the control grid is spaced apart from each of the respective electrodes for the first cathode and the second cathode where they exit said discharge chamber by a distance in the range of about 2 centimeters to 20 centimeters.

7. A bidirectional gas discharge tube (GDT) comprising:

a discharge chamber;

a first cathode disposed within the discharge chamber;

a second cathode disposed within the discharge chamber;

a gas disposed within the discharge chamber and configured to insulate the first cathode from the second cathode;

a first control grid disposed adjacent the first cathode and between the first cathode and the second cathode within the discharge chamber, the first control grid configured to generate a first electric field to initiate establishment of a conductive plasma between the first cathode and the second cathode to close a conduction path extending between the first cathode and the second cathode;

a second control grid disposed adjacent the second cathode and between the first cathode and the second cathode within the discharge chamber, the second control grid configured to generate a second electric field to initiate establishment of the conductive plasma and to close the conduction path; and at least one insulating barrier at least partially defining the discharge chamber, wherein the at least one insulating barrier is/are spaced apart from each of the first cathode and the second cathode by a distance of approximately 0.5 to 1 millimeter;

wherein the at least one insulating barrier defines a first space between the first control grid and the at least one insulating barrier, and a second space between the second control grid and the at least one insulating barrier, the first space and the second space being in a range of approximately 0.5 to 1.0 millimeters.

8. The bidirectional GDT of claim 7, wherein the first control grid and the second control grid form a single high-voltage standoff region between the first control grid and the second control grid.

9. The bidirectional GDT of claim 8, wherein one of the first control grid or the second control grid that is adjacent an electron emitting one of the first cathode or the second cathode is energized to interrupt normal forward current for a sufficient duration to deionize said gas in the single high-voltage standoff region between the first control grid and the second control grid.

10. The bidirectional GDT of claim 7, wherein at least one of the first cathode or the second cathode is a thermionic cathode.

11. The bidirectional GDT of claim 10, wherein the thermionic cathode comprises lanthanum hexaboride (LaB6).

12. The bidirectional GDT of claim 7, wherein the first control grid and the second control grid have rounded edges.

13. The bidirectional GDT of claim 7, wherein the first control grid and the second grid are spaced apart by a distance in the range of about 0.25 to 10 centimeters.

14. The bidirectional GDT of claim 7 further comprising:

a first electrode for the first control grid extending externally from the discharge chamber; and a second electrode for the second control grid extending externally from the discharge chamber and spaced apart from the first electrode by a distance in the range of about 2 to 20 centimeters.

15. The bidirectional GDT of claim 7, wherein the gas comprises deuterium.

16. The bidirectional GDT of claim 7, wherein the gas comprises xenon.

* * * * *